US005515804A

United States Patent [19]

Pollack

[11] Patent Number: 5,515,804

[45] Date of Patent: May 14, 1996

[54] BEARING SUPPORT FOR SINGLE POINT TERMINAL

[75] Inventor: Jack Pollack, Calabasas Hills, Calif.

[73] Assignee: Imodco, Inc., Calabasas Hills, Calif.

[21] Appl. No.: 517,149

[22] Filed: Aug. 21, 1995

[51] Int. Cl.[6] ..... B63B 21/00

[52] U.S. Cl. ..... 114/230; 441/5

[58] Field of Search ..... 114/230, 293, 114/264; 441/3–5

[56] References Cited

U.S. PATENT DOCUMENTS

| | | | |
|---|---|---|---|
| 4,701,143 | 10/1987 | Key et al. | 441/5 |
| 4,876,978 | 10/1989 | O'nion et al. | 114/230 |
| 4,955,310 | 9/1990 | Pollack | 441/5 |

*Primary Examiner*—Stephen Avila
*Attorney, Agent, or Firm*—Freilich Hornbaker Rosen

[57] ABSTRACT

An arrangement is described for mounting a turret (18, FIG. 3) on the outer ends of beams, or mounts, whose inner ends are supported by a vessel hull (14) that can weathervane about the turret. An upper bearing (42) is supported on a largely rigid upper mount (30), by a resiliently deflectable support structure (50) that includes a plurality of elastomeric shear pads (52). Each shear pad subtends an angle (B, FIG. 5) of no more than 20° about a common point (26) along the rotatable axis of the turret. This allows a shear pad to use flat rubber sheets instead of spherically curved sheets, as well as avoiding excess stiffness. The support structure includes six posts (54) extending radially from the common point along the turret axis, each post having a gap where a shear pad is mounted, with the area around each shear pad being open to facilitate replacement of a shear pad. A limiter which extends in parallel with the shear pads to prevent them from being torn loose in the event of bearing seizing, can include a limiter member (122, FIG. 11) fixed with respect to one mount plate (70) of a shear pad and surrounding the opposite mount plate (72) of the shear pad.

18 Claims, 5 Drawing Sheets

BEARING SUPPORT FOR SINGLE POINT TERMINAL

BACKGROUND OF THE INVENTION

My earlier U.S. Pat. No. 4,955,310 describes an arrangement for supporting an upper turret bearing on a rigid beam or mount, which allows the upper bearing to tilt by a small angle about horizontal axes, by the use of elastomeric material. That patent describes spherically curved sheets of elastomeric material separated by steel plates and lying immediately outside the turret, within a precisely formed recess in a rigid beam. This arrangement has disadvantages, in that the need for spherical curvature of the separating plates and elastomeric sheets adds expense, the arrangement makes access to the shear pad or pads difficult and a precisely formed recess is expensive, and the shear pads are likely to be so stiff as to not allow bearing tilt without damage to the turret or mount. A resiliently deflectable support structure which was of relatively low cost and which provided relatively easy access for installation and replacement, would be of value.

SUMMARY OF THE INVENTION

In accordance with one embodiment of the present invention, apparatus is provided for supporting a turret-holding upper bearing on a rigid beam or mount, which includes a plurality of elastomeric shear pads that can be constructed at low cost and to which there is easy access. Each shear pad includes a stack of elastomeric sheets separated by rigid plates, and with wider top and bottom mounting plates. The shear pads face towards a common point on the turret axis of rotation. A large number of small diameter shear pads, preferably more than four, are used, with each shear pad subtending an angle of no more than 20° from the common point. The bearing is supported on a plurality of posts inclined toward the axis, with each post having a gap and with each shear pad lying in the gap, which enables ready access to the shear pads for installation and replacement. The posts are supported on a collar that needs to be only moderately stiff and which positions the posts with only moderate precision.

To avoid breakage of the shear pads in the event that the upper bearing seizes, a limiter structure is coupled to the upper bearing and to the rigid mount to limit their relative angular rotation to a small angle such as 2°. The limiter structure can include a pair of limiter members, each having one end fixed with respect to one mounting plate of a shear pad, and having an opposite end surrounding the other mount plate of the shear pad.

An upper bearing device which can temporarily support and confine the turret upper portion during replacement of the main upper bearing, includes a turret bearing part fixed to the turret and a mount bearing part fixed to the rigid mount. The temporary bearing parts engage each other only during relatively large radial or axial displacement of the turret upper portion, which is slightly more than that permitted by the regular upper bearing.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
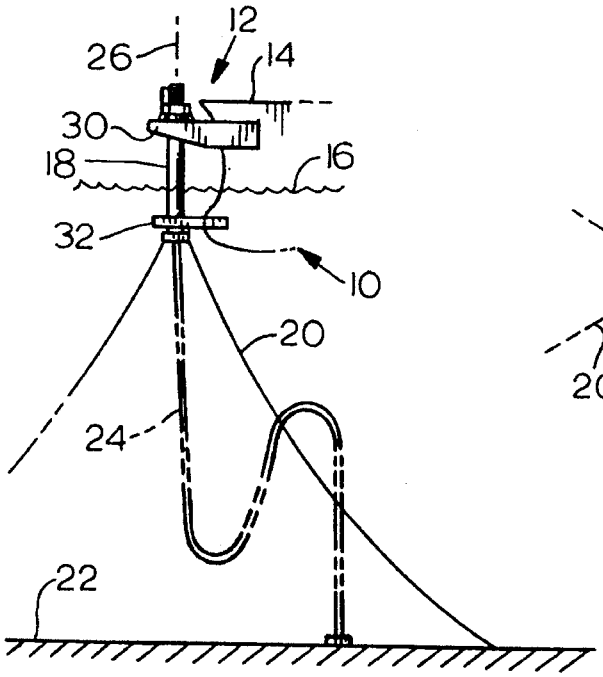
FIG. 1 is a side elevation view of an offshore terminal of the present invention.

FIG. 1 illustrates a mooring arrangement 10 wherein a vessel 12 has a hull 14 that floats at the sea surface 16, and that is moored through a turret 18 held by catenary chains 20 or other anchoring structure that extends down to the sea floor 22. A conduit 24 is indicated, which extends up from the sea floor to the turret to transfer hydrocarbons between the vessel hull and an underground line that may extend from undersea oil wells. While the vessel hull 14 may drift and may turn without limit, the turret 18 does not turn much, so the vessel rotates about a turret axis 26. The turret is rotatably supported with respect to the hull by upper and lower mount assemblies 30, 32.

Figure 3:
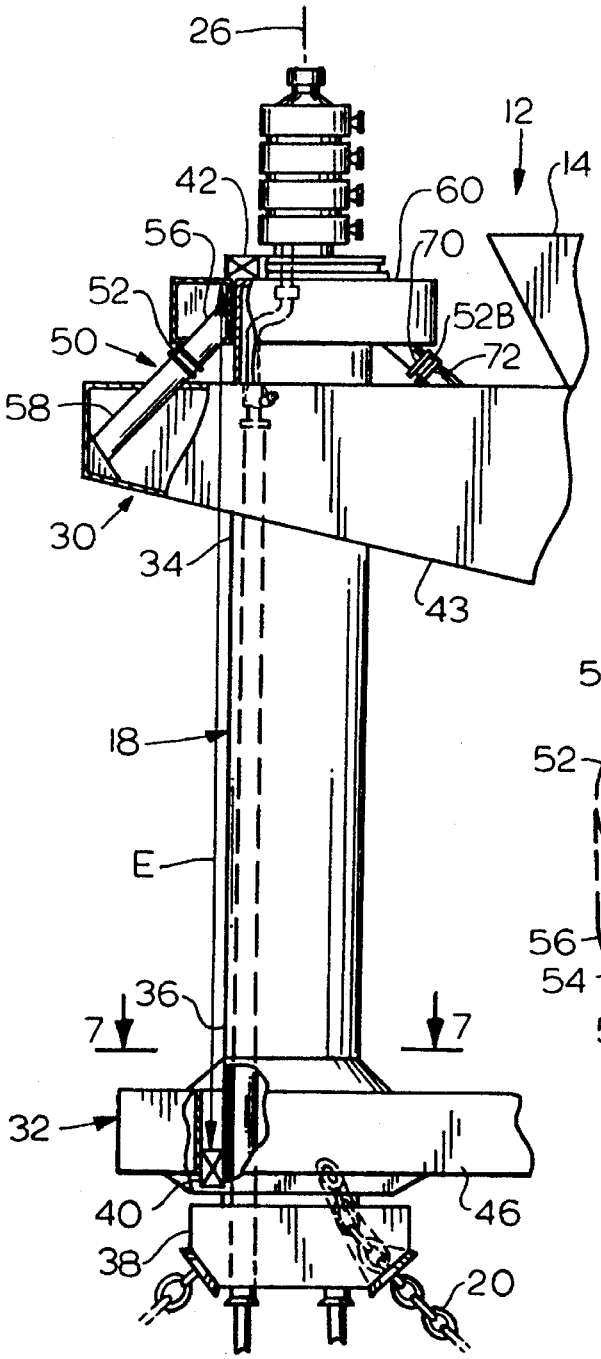
FIG. 3 is a partial sectional side elevation view of a portion of the terminal of FIG. 1.

FIG. 3 shows the manner in which the turret 18 is supported on the vessel. The turret has upper and lower portions 34, 36 supported by the mount assemblies, and has a lower end 38 anchored by the mooring chains or lines 20. The lower mount assembly includes a lower bearing 40 that preferably limits only radial movement of the turret with respect to the axis 26. The upper mount assembly includes an upper bearing 42 that limits both radial and downward axial movement of the turret.

In the construction of a turret mount, it is difficult to mount the upper and lower radial bearing portions so they lie in precise alignment, as by maintaining their axes parallel within one-tenth degree. For example, even if the bearings are precisely aligned when the turret is initially installed, the great weight of chains that are later added will cause bending of a substantially rigid upper beam 43 of the mount assembly 30 that is fixed to the vessel hull and that supports the upper bearing. It is difficult to precisely calculate the bending to compensate for it, and to install bearings with precise compensation.

Figure 2:
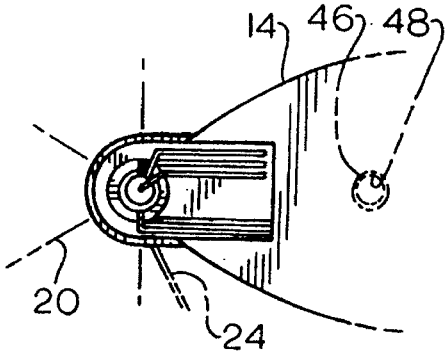
FIG. 2 is a partial plan view of the terminal of FIG. 1.

It is noted that the turret 18 can lie within a moonpool, or vertical cavity within the vessel hull, in which case the largely rigid mount or mount assembly 30 is a strengthened section of the hull. FIG. 2 shows a turret at 46 lying in a moonpool at 48.

Figure 4:
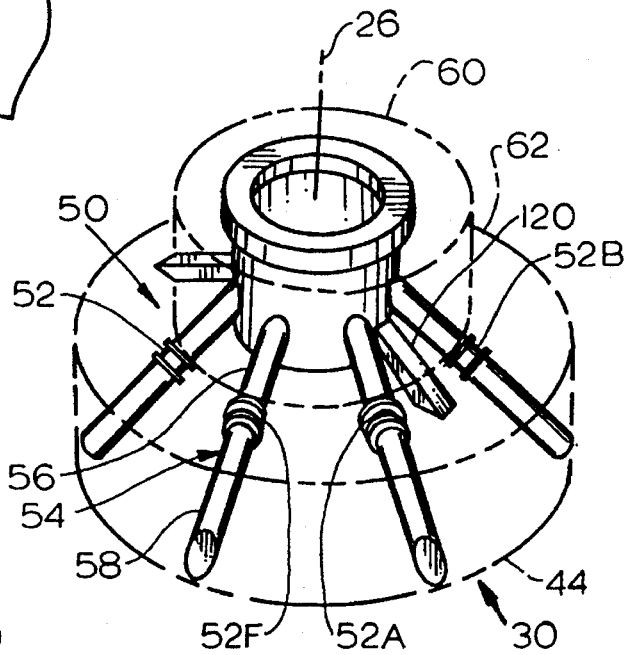
FIG. 4 is an isometric view of a portion of the terminal of FIG. 3, showing the resiliently deflectable support structure thereof.
Figure 4A:
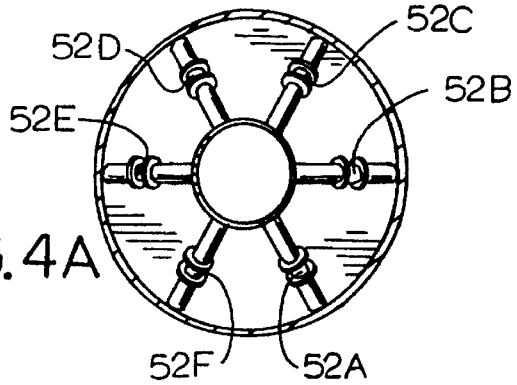
FIG. 4A is a sectional top view of a portion of the terminal shown in FIG. 4.

The upper mount assembly 30 includes a resiliently deflectable support structure 50 which supports the upper bearing 42 on the largely rigid mount 30. As indicated in FIG. 4, the resilient support structure 50 includes a plurality of spaced elastomeric shear pads 52, with the particular structure including six of such pads 52A–52F as shown in FIG. 4A. Each shear pad is mounted in line with one of six corresponding posts 54, with each post having upper and lower post portions 56, 58. The upper post portion 56 is attached to an outer bearing support structure 60, while the lower post portion 56 is attached to an upper collar 62 which is part of the largely rigid mount 30 that extends from the vessel hull.

Figure 6:
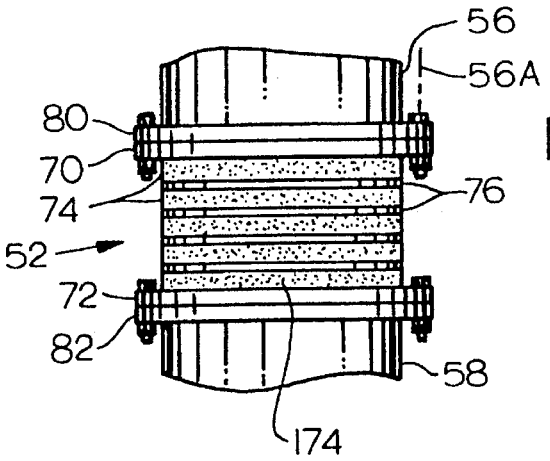
FIG. 6 is a side elevation view of a shear pad and of post portions connected thereto, of the terminal of FIG. 3.

FIG. 6 shows details of one shear pad 52. The shear pad, which is vulcanized into a single assembly, includes top and bottom steel mounting plates 70, 72, a group of elastomeric sheets 74 of an elastomeric material such as rubber of a shore such as 60, and a plurality of rigid steel spacer plates 76 that separate the elastomeric sheets to control their deformation in shear. The top mounting plate 70 is attached to a corresponding flange 80 on the upper post portion 56 while the bottom mounting plate 72 is attached to a corresponding flange 82 of the lower post portion 58. The shear pad 52 can take large compressive forces transmitted through the post, and allows the upper post portion 56 to move sidewardly from an initial position, as to the position 56A, which is accommodated by shear of the elastomeric sheets 74.

As shown in FIG. 3, the mounting plates of each shear pad such as 52B and adjacent portions of the post associated therewith, are substantially unobstructed in sideward directions. This facilitates installation and replacement of a shear pad by sideward movement into or out of the gap between the upper and lower post portions. Applicant prefers to position the shear pads symmetrically about the turret axis 26. At least three pads are required. It is desirable that the support structure 50 include at least five of such shear pads and corresponding posts, so the upper portion of the turret is stably supported even when one of the shear pads is removed. If only four shear pads are used, which are spaced 90° apart, then the removal of one shear pad would leave 180° between the centers of adjacent shear pads, and almost 180° or one side of the turret unsupported. Applicant actually prefers to use six or more of such shear pads, which is an even number that facilitates design.

Figure 5:
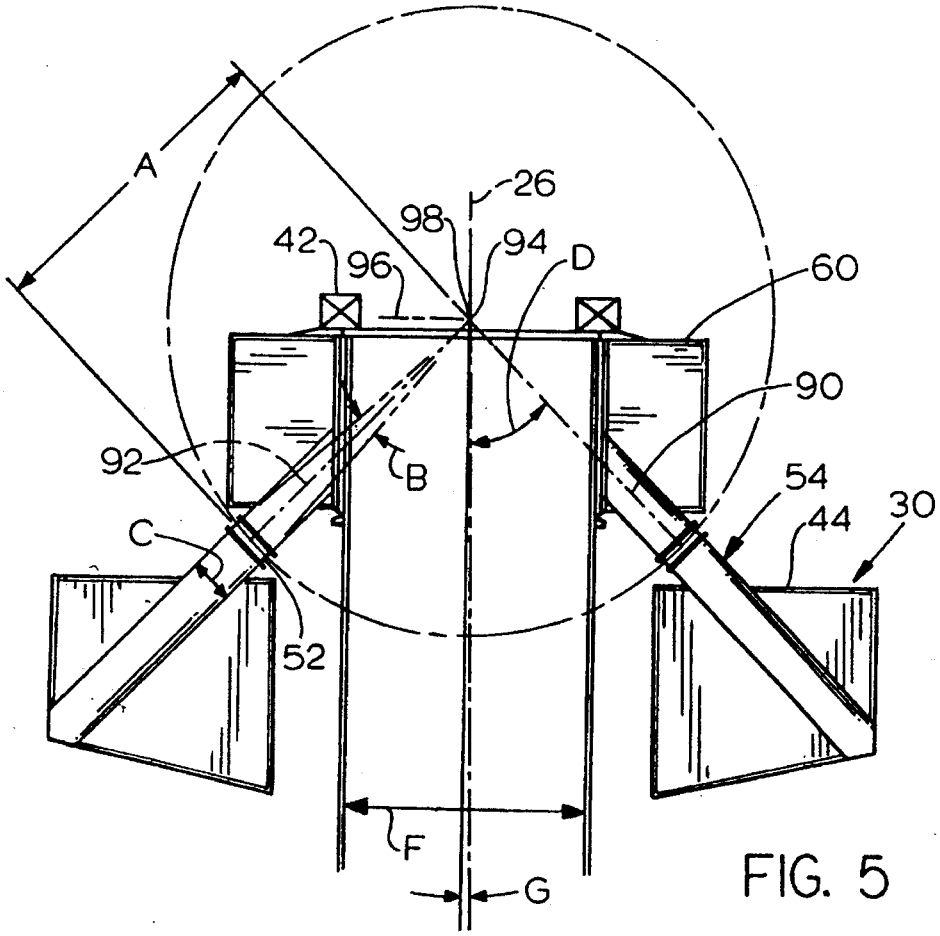
FIG. 5 is a simplified sectional side view of a portion of the terminal of FIG. 3.

As shown in FIG. 5, all of the shear pads face along imaginary lines such as 90, 92 that extend orthogonal to the middles of the pads and that extend substantially through a common point 94 lying on the turret axis of rotation 26. FIG. 5 is a side sectional view that passes through the axis 26 and the lines 90, 92. Such an approximate orientation is necessary so that each shear pad allows the support structure 60 and upper bearing 42 thereon to pivot about horizontal axis 96, 98 that extend through the common point 94. It is noted that the shear pads can be spaced at different distances from the common point, although equal spacing is preferred. Each of the spacer plates of a shear pad 52 can be spherically curved about the common point 94. In fact, if the shear pads 52 should lie close to the common point 94 so they occupy a large angle B, then such spherical curving of the spacer plates and corresponding elastomeric sheets is necessary in order to assure that the pads will permit uniform shear movement. Applicant is able to use substantially flat rigid spacer plates 76 (FIG. 6), by placing the shear pad a large distance A (FIG. 5) from the common point 94. This results in a relatively small angle B subtended by each shear pad 52 from the common point 94 as viewed in FIG. 5. It may be noted that applicant prefers to use shear pads of circular cross-section, although they can be of square or other cross-section wherein their width and length are not too different from each other.

Applicant prefers that the angle B subtended by each shear pad be no more than 20°, so that opposite sides of the shear pad are angled no more than 10° from a direction towards the common point 94. Such relatively small angle permits the use of flat spacer plates 76 (FIG. 6) while still obtaining substantially the same shear capability as for a spherical spacer plate. By a "flat" spacer plate, applicant means a spacer plate whose radius of curvature is at least twice the distance A (FIG. 5) between the shear pad and the common point 94. Applicant chooses the distance A between the common point 94 and each shear pad 52, to enable the use of a shear pad of a proper diameter C. The diameter C is chosen to provide the proper degree of resilience in shear, to provide moderate resistance to tilt of the bearing 42 while allowing such tilt when forces are applied that are less than those that would damage parts of the mounting assemblies such as the support mounting assemblies 60 or collar 44 of the largely rigid mount or mount assembly.

Figure 9:
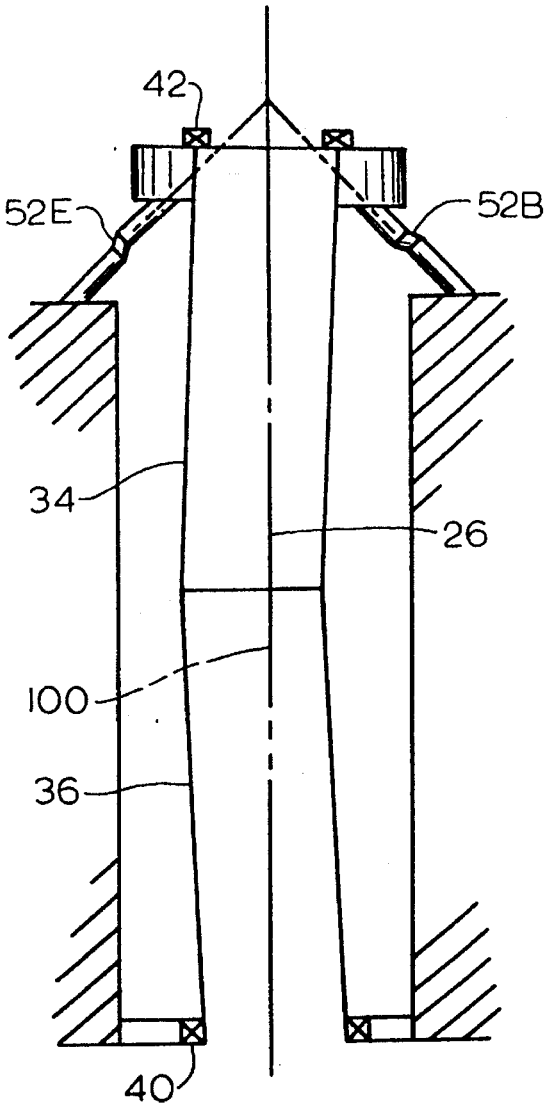
FIG. 9 is a diagrammatic view showing the effects of bearing misalignment in one rotational position of the vessel.
Figure 10:
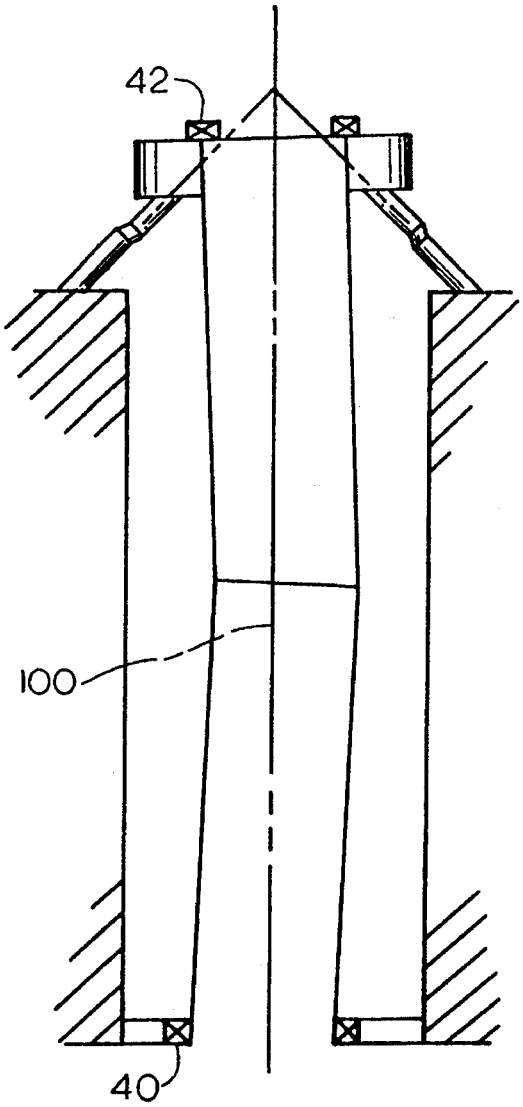
FIG. 10 is a view similar to that of FIG. 9, but showing the effects at a rotational position of the vessel which is 180° from that of FIG. 9.

As mentioned earlier, the need for resilient mounting of the upper bearing results primarily from misalignment of the upper and lower bearings when the heavy weight of chains causes bending of the upper beam or mount in an amount that cannot be precisely compensated for. FIGS. 9 and 10 are exaggerated views that show how the upper bearing 42 moves from one side to the other of a nominally vertical line 100, for the case where the turret upper portion 34 is misaligned with the turret lower portion 36. The axis of rotation of the turret 26 passes through the center of the spherical surface that is defined by the shear pads 52 (point 94 in FIG. 5) and passes through the center of the lower bearing. (The axis will deviate from the center of the upper bearing when there is eccentricity between the upper and lower bearings). Where the turret lies in a cavity, or "moonpool", in the hull of the vessel, then bending forces on the hull can cause the beams that support the posts to bend from a circular shape to a slightly oval or other noncircular shape. In ovaling, some shear pads move slightly closer together (and take more load) while other shear pads move further apart. Proper choice of shear pad axial and shear stiffness can keep the pads loads largely equal even in the event of ovaling.

Figure 7:
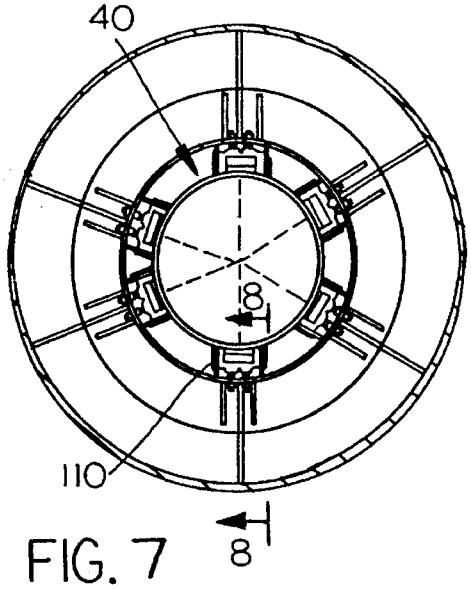
FIG. 7 is a sectional top view of the lower support structure, taken on line 7—7 of FIG. 3.
Figure 8:
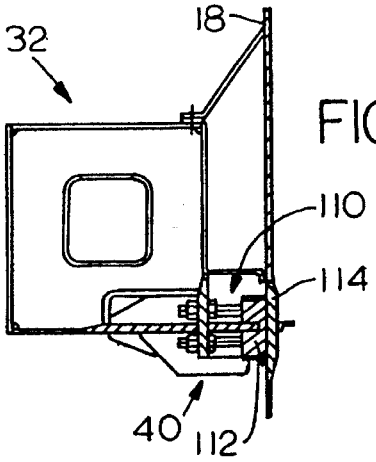
FIG. 8 is a sectional view taken on line 8—8 of FIG. 7.

FIGS. 7 and 8 illustrate some details of the lower bearing 40, which includes six lower bearing segments 110 that each includes a slider bearing segment 112 of a long wearing low friction material, which bears against a slider ring 114 of hard, low friction, and corrosion-resistant material, that is mounted on the turret. As in the case of the upper mount assembly, applicant prefers to provide at least five lower bearing segments (and preferably at least six), so even if one lower bearing segment is removed, there is less than 180° between the centers of any two adjacent lower bearing segments.

Figure 8A:
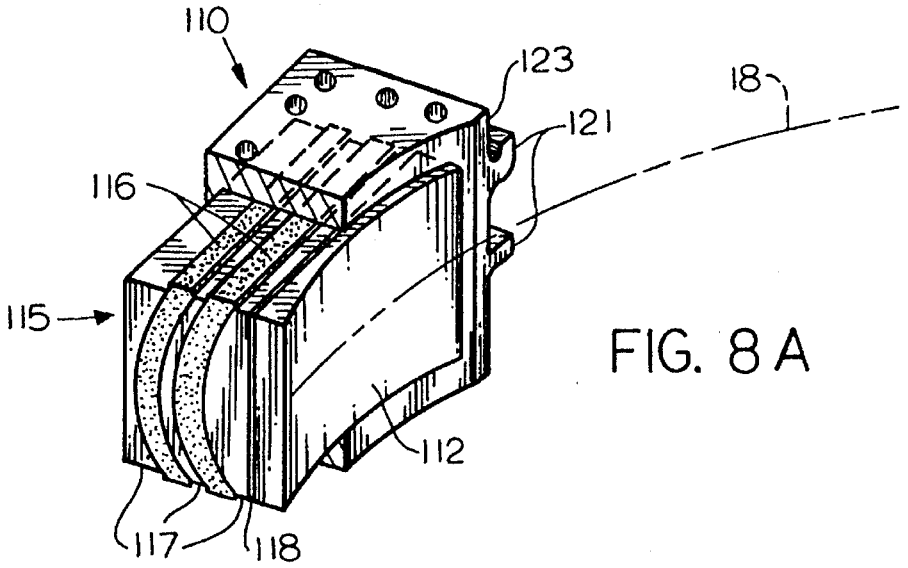
FIG. 8A is a partial sectional and isometric view of a lower bearing segment of the structure of FIG. 7.

FIG. 8A is a simplified view of one bearing segment 110. The segment includes an angulation pad 115 comprising two plates 116 of elastomeric material and three plates 117 of rigid material such as steel having part-cylindrical shapes. The angulation pads allow the bearing segment 112 to tilt about a horizontal axis to allow it to following the turret when the turret wobbles during turning, due to misalignment. The bearing segment also includes a shim 118 to help assure that the slider segment 112 will press against the slider ring on the turret. The pad 115 is loosely contained in a bearing box 119 that is fixed to the lower mount of the lower mount assembly 32. The slider segment is loosely held in the box 119, so the slider segment 112 can tilt by perhaps 1° while assuring that the slider ring will turn with the vessel around the stationary turret indicated at 18. The box 119 has mounts 121 for mounting on the lower mount. The box has a removable cover 123 that enables replacement of the shear pad 115 and shim. It is possible to curve the rigid plates 117 spherically although this is more expensive. The cylindrical or spherical surfaces can also be provided by sliding surfaces which allow the same motion that is allowed by elastomeric plates.

The construction of the support structure 50 (FIG. 3) with six shear pads 52 lying along posts, gives rise to the possibility of disastrous failure in the event that the upper bearing 42 seizes; that is, in the event that the upper bearing locks so the turret 18 turns with the vessel hull. Since the bearing pads 52 have only moderate resistance to shear, such seizing of the upper bearing would result in all six shear pads 52 being completely sheared, and the turret dropping until the support structure 60 dropped onto the rigid mount 30. To prevent such catastrophe, applicant provides a limiter that limits relative rotation of the upper and lower post portions 56, 58. FIG. 4 shows a relatively simple limiter formed by at least two bars 120, each having one end fixed to the rigid mount 30 and another end lying in a slot of the outer support structure 60. With a limiter in place, the effect of upper bearing seizure will be some twisting and wrapping of the anchor chains 20, which will not cause harm in mild weather conditions.

Figure 11:
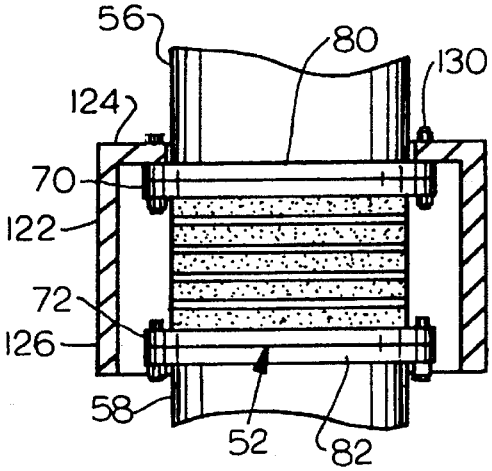
FIG. 11 is a partially sectional view of a limiter constructed in accordance with another embodiment of the invention, shown mounted on the shear pad of FIG. 6.

FIG. 11 shows a preferred limiter arrangement formed by a limiter member 122 having an upper limiter end 124 that is fixed to the flange 80 that lies at the lower end of the upper post portion 56. The limiter member has a lower portion 126 which surrounds the lower post portion 58, as by surrounding the flange 82 at the upper end of the lower post portion. The limiter member 122 prevents lateral displacement of the upper and lower mount plates 70, 72 of the shear pad 52, to prevent so much shear that the shear pad would be destroyed. However, the limiter member 122 does not interfere with limited shear movement of the upper and lower shear pad mounting plates. The limiter member 122 can be mounted anywhere along one of the post portions, including one of the shear pad mount plates, and its opposite end can surround any location along the other post portion or the other shear pad mount plate. The arrangement in FIG. 11 enables easy access to the shear pad 52 for inspection or replacement. All that is required is removal of bolts 130 that hold the upper limiter end 124 to the flange 80, and upward movement of the limiter member 122 to gain access to the pad 52. Limiter members 122 must be installed on at least two posts, or shear pads. The shear pad 52 is substantially unobstructed, in that normally no heavy load-carrying member must be removed to gain access to the shear pad mounting plates.

In a system that applicant has designed, the turret 18 has a length E (FIG. 3) of 20 meters between the lower and upper bearings 40, 42, and the turret has a diameter F of 4 meters along most of its length. Such ratio of length to diameter of five to one (less than ten to one) results in a relatively stiff turret that cannot readily bend to take up bearing misalignment, which necessitates the need for resilient mounting of the upper bearing. In some prior turrets wherein the ratio of length to diameter is more then ten to one, the turret may be sufficiently resilient to avoid the need for resilient mounting of the upper bearing. The total weight supported by the upper bearing 42 is 1200 tons, so each shear pad 52 is loaded in compression by a load of 200 tons. Because of such initial compression loading, any pivoting of the upper bearing may decrease the compression loading on some of the shear pads, but will not result in tension across any shear pad.

Referring to FIG. 5, each shear pad has a diameter C at its elastomeric sheets, of 25 inches and its center is located a distance A of 4 meters from a common point 94 on the turret axis 26, towards which all of the shear pads face. As a result, each shear pad subtends an angle B of 10°. As mentioned above, it is highly desirable that each shear pad subtend an angle B of less than 20°, so the spacer plates of each shear pad can be substantially flat instead of requiring them to be spherically curved about the common point 94 to avoid a net tension and separation of layers at one side of the shear pad during upper bearing tilt.

Each of the posts 54 extends at an angle D of 45° to the axis 26. Applicant prefers an angle D between 30° to 60°. If the angle D were near 90° (the posts extend horizontally), the 1200 tons of downward force would cause failure of all shear pads, as they would be loaded primarily in shear wherein they have low load capacity. An angle D close to 0° results in turret misalignments that cause primarily axial pad deformations which result in large axial shear pad load changes, as the pads are axially stiff when compared to their shear stiffness. It is possible to use an angle of 90° with very soft rubber, so the structure is essentially supported on springs, but this is usually undesirable. The system is designed to accommodate a tilt angle G of up to 2°, with the limiter preventing any further shear of the shear pads. In actual use, it is expected that a tilt angle G of about one-quarter degree will be encountered. The approximately 200 mm thickness of elastomeric material is initially compressed by about 5 mm.

Figure 10A:
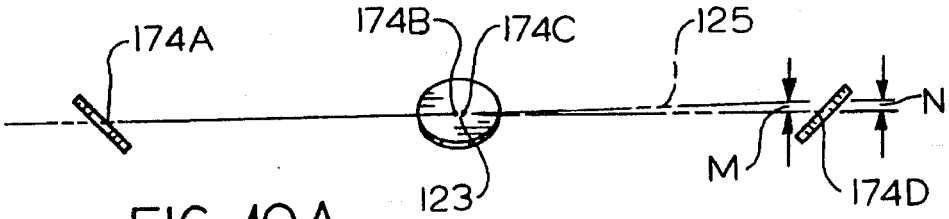
FIG. 10A is a diagrammatic view of the support structure of FIG. 4.

The use of shear pads 52 enables applicant to use an upper mount 30 that is of only moderate stiffness and precision. For a turret of 4 meters diameter, if elastomeric shear pads are not used then the bearing mount must be very precise and stiff. This is to assure that locations on a steel support that engage the bearing to hold it, cannot lie more than about 0.025 inch above or below a plane defined by any three of the other locations. Such precision is required even in moderately rough weather (wave height 50% above average at that location), so the support must be stiff. However, with the presence of the shear pads 52, the upper mount 30 that supports the upper bearing through rigid posts and elastomeric bearing pads, need not be very rigid or precise. Instead, each lower pad locations at 174 (FIG. 6) can lie at least 0.25 inch above or below a plane defined by three other pad locations that lie at the lower ends of the shear pads. Thus, required rigidity and precision of construction of the upper mount can be at least one order of magnitude (at least 10 times) less than required in the prior art. The lower precision and rigidity can be defined, as shown in FIG. 10A, by describing the angular deviation M in degrees of the center 174D of the lower end of a bearing pad, from center location 123 on a plane 125 defined by locations 174A, 174B, and 174C on three other pads. The angular deviation can be at least 0.1°, or one-tenth degree, and the offset distance N can be at least 0.25 inch, for a turret of about 4 meters diameter (2 to 8 meters diameter). If the upper or lower post portions 56, 58 (FIG. 4) are not all of the same length, then the above described deviation or offset is adjusted accordingly.

Figure 12:
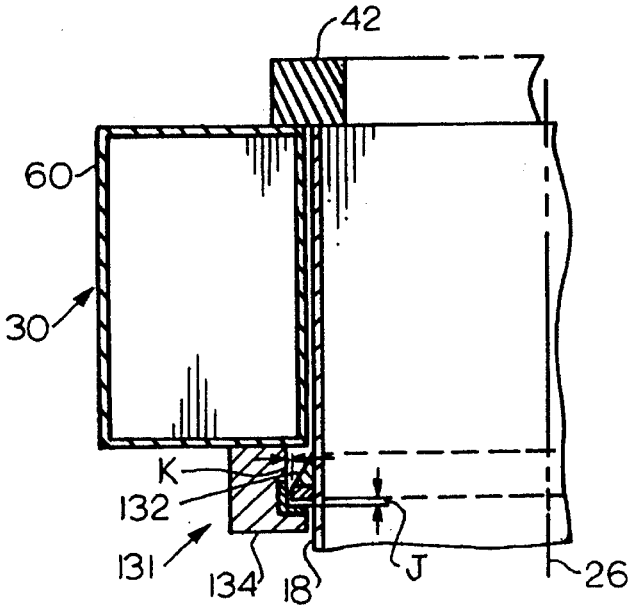
FIG. 12 is a partially sectional side view showing apparatus for aiding in the replacement of a turret upper bearing.

If the upper bearing has to be replaced, it is highly desirable if the turret can continue to be rotatably supported. FIG. 12 shows an arrangement 131 that facilitates replacement of an upper bearing 42. The arrangement includes one turret bearing part 132 that is fixed to the turret 18 and a mount bearing part 134 that is fixed to the support structure 60 of the upper mount assembly 30. The bearing parts 132, 134 are constructed and positioned so there is an axial gap J between the bearing parts and a radial gap K between them. The gaps J, K are great enough that the bearing parts 132, 134 will not engage each other when the regular upper bearing 42 is in place. However, when the bearing 42 is removed, the turret will move down a distance J so the weight of the turret is borne by the mount bearing part 34 while the mount bearing part also limits radial movement of the turret upper portion. When a new regular upper bearing 42 is to be installed, a jacking device is necessary to raise the turret, but since the jacking device has to raise the turret only a small distance J such as one-quarter inch, the jacking device can be relatively simple, the group of bolts that are used to fasten bearing 42 to turret 18.

Figure 13:
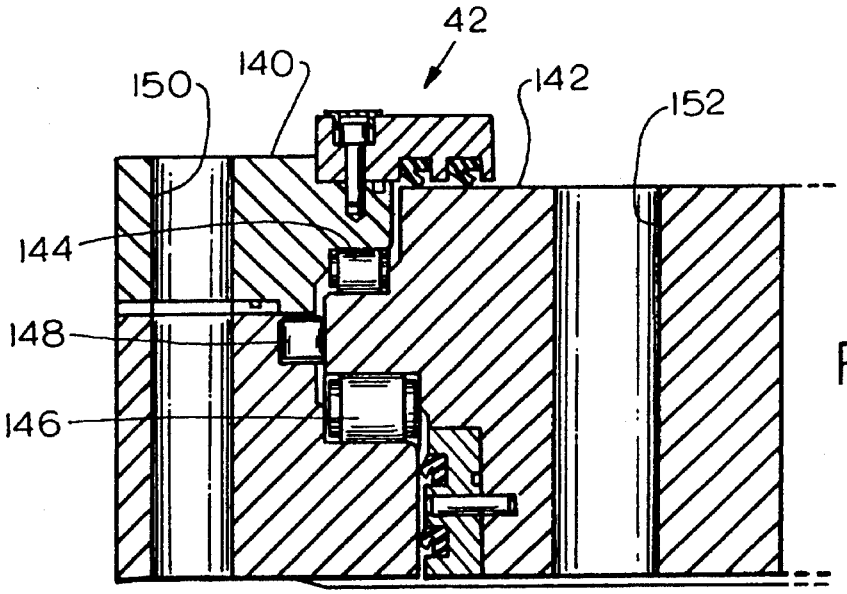
FIG. 13 is a sectional view of the upper bearing of FIG. 12.

FIG. 13 illustrates one type of upper bearing 42 which includes a rotatable part 140 and a nonrotatable part 142. The particular bearing has two sets of axial rollers 144, 146 and one set of radial rollers 148. Holes 150, 152 are for receiving fasteners to mount respectively to the support structure 60 and to the turret 18. A variety of upper bearings can be used, such as sliding bushings (either segmented or continuous) and bogies wheels.

Figure 14:
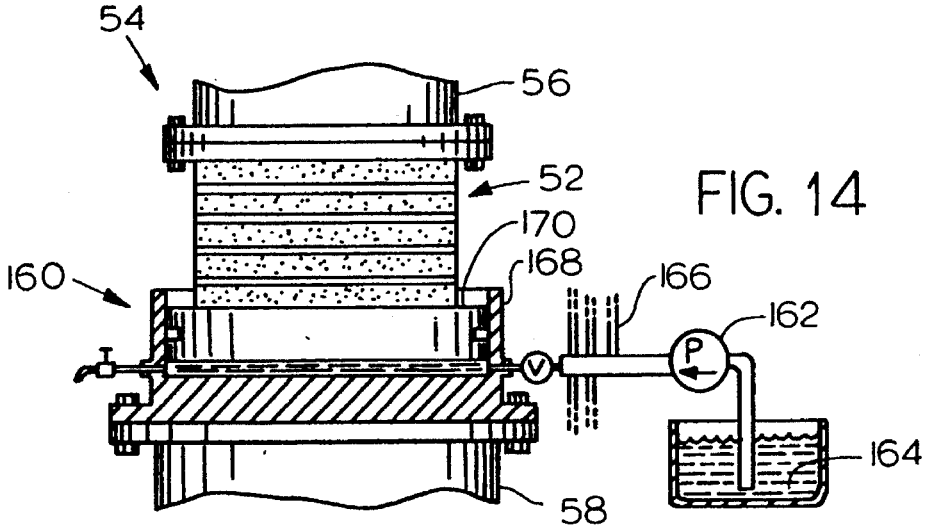
FIG. 14 is a sectional view of a portion of a mooring arrangement of another embodiment of the invention.

FIG. 14 illustrates one of six hydraulic actuators 160 that can be placed along each post 54. The actuators 160 minimize misalignment during initial installation of the turret and upper bearing. After the turret has been installed on the upper and lower bearings and the upper bearing has been placed on the six posts 54, a pump 162 pumps hydraulic fluid 164 through each of six conduits 166 to the cylinder part 168 of each actuator. The pressured fluid raises each actuator piston part 170 and the corresponding shear pad 52, upper post portion 56, and a location around the upper bearing. All six actuators apply the same force, so the pistons 170 of the different actuators move by slightly different amounts until there is an equal load applied along each post 54. When the loads are equal, the upper and lower bearings are aligned.

The actuators 160 can be operated after the mooring chains have been applied to the lower end of the turret, to account for bending due to such loads; however, this can be dangerous unless the weather remains calm during installation. Applicant prefers to use grout as the hydraulic fluid 164, so the lengths of the actuators become fixed. It is possible to instead weld the piston and cylinders together. The actuators 160 can be placed anywhere along the posts. The use of hydraulic actuators between the rigid mount (44) and the upper bearing is especially useful where there are shear pads, but can be used even where there are no shear pads.

Thus, the invention provides a resiliently deflectable support structure which supports an upper bearing on a rigid upper mount, which is of relatively low cost and easy maintainability. The deflectable support structure includes a plurality of shear pads that all face substantially towards a common point along the turret axis, with the distance of the shear pads from the common point and the diameters of the shear pads being chosen so each shear pad subtends an angle of no more than 20° from the common point. The shear pads preferably have substantially flat rigid and elastomeric plates for low cost construction. The shear pads preferably lie along narrow posts, with areas sidewardly around the mounting plates of the shear pads being substantially unobstructed for easy maintenance and replacement. The shear pads are preferably uniformly spaced about the turret axis, and there are preferably at least five and more preferably at least six shear pads, to facilitate replacement of a single shear pad. A limiter structure limits relative pivoting of upper and lower post portions, and preferably includes a pair of limiter members that are each coupled to one of the shear pads, with each limiter member having one end fixed to a post portion or shear pad mount plate, and an opposite end portion surrounding the other post portion or other mount plate. Replacement of a damaged upper bearing is facilitated by an upper bearing device which includes a turret bearing part fixed to the turret and a mount bearing part fixed to the mount, with both axial and radial gaps between the bearing parts so they do not engage until the regular upper bearing is removed. Initial installation can be accomplished by using hydraulic actuators to slightly lift locations about the upper bearing to align it with the lower bearing.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A mooring arrangement which includes a vessel with a hull that floats at the surface of a sea and that can drift and weathervane, a turret, and vertically spaced upper and lower mount assemblies holding vertically spaced upper and lower portions of the turret to the hull to enable relative rotation of the vessel and turret about a largely vertical axis, wherein the turret has a lower end anchored by at least one mooring line or the like extending down toward the sea floor which applies a largely downward force to the lower end of the turret, wherein said lower mount assembly includes a lower bearing that limits radial movement of said turret with respect to said axis, and said upper mount assembly includes an upper bearing that limits both radial and downward movement of said turret with respect to said axis, said upper mount assembly also including a substantially rigid mount fixed to said vessel hull and a resiliently deflectable support structure which supports said upper bearing on said upper mount, wherein said resiliently deflectable support structure includes a plurality of spaced elastomeric shear pads that each includes a plurality of elastomeric sheets that are oriented so imaginary orthogonal lines extending through middles of the sheets of said plurality of shear pads substantially intersect at a common point lying on said axis, characterized by:

each of said shear pads subtends an angle of no more than 20° about said common point, as seen in a side sectional view of the turret that passes through said axis and through a corresponding one of said imaginary lines.

2. The mooring arrangement described in claim 1 wherein:

said support structure includes a plurality of posts each having an upper post portion coupled to said upper bearing to support it and a lower post portion coupled to said rigid mount to be supported thereon, said posts each forming a gap between said post portions, and including a shear pad lying in said gap and connecting said upper and lower post portions, with each of said shear pads including top and bottom mounting plates each connected to a corresponding post portion, and with each of said post portion being narrow enough near said shear pads to leave the corresponding mounting plate of the shear pad substantially unobstructed for easy replacement of the shear pad.

3. The mooring arrangement described in claim 1 wherein:

said bearing has rotatable and nonrotatable bearing parts; and including a limiter structure coupled to said upper bearing rotatable part and to said upper mount, which prevents their relative rotation by more than a predetermined amount, which is no more than about 2°, which would destroy said shear pads.

4. The mooring arrangement described in claim 3 wherein:

first and second of said shear pads each has upper and lower ends, and said limiter structure includes a pair of limiter members each having one limiter end rigidly connected to one shear pad end of a corresponding one of said first and second shear pads, and each limiter member having an opposite limiter end that substantially surrounds the other shear pad end of a corresponding one of said first and second shear pads.

5. The mooring arrangement described in claim 1 wherein:

each of said elastomeric sheets of each of a plurality of said shear pads is substantially flat.

6. The mooring arrangement described in claim 1 wherein:

said plurality of shear pads comprises at least five shear pads that are spaced apart around said axis by less than 90°.

7. The mooring arrangement described in claim 1 including:

an upper bearing device which can temporarily support and confine said turret upper portion during replacement of said upper bearing, comprising a turret bearing part fixed to said turret and a mount bearing part fixed with respect to said upper mount, with said bearing parts engaging each other when said turret upper portion moves radially by an amount that is greater than the radial confinement provided by said upper bearing, and when said turret moves down from a position at which it is supported by said upper bearing.

8. A mooring arrangement which includes a vessel with a hull that floats at the surface of a sea and that can drift and weathervane, a turret, and vertically spaced upper and lower mount assemblies holding vertically spaced upper and lower portions of the turret to the hull to enable relative rotation of the vessel and turret about a largely vertical axis, wherein the turret has a lower end anchored by at least one mooring line or the like extending down toward the sea floor which applies a largely downward force to the lower end of the turret, wherein said lower mount assembly includes a lower bearing that limits radial movement of said turret with respect to said axis, and said upper mount assembly includes an upper bearing that limits both radial and downward movement of said turret with respect to said axis, said upper mount assembly also including a largely rigid mount fixed to said vessel hull and a resiliently deflectable support structure which supports said upper bearing on said upper mount, wherein said resiliently deflectable support structure includes a plurality of spaced elastomeric shear pads arranged substantially in a circle, with each shear pad including a plurality of elastomeric sheets that are oriented so imaginary orthogonal lines extending through middles of the sheets of said plurality of shear pads substantially intersect at a common point lying on said axis, characterized by:

each of said shear pads has a lower end location at the center of the shear pad, with said lower end locations lying largely in the same plane;

said largely rigid mount is sufficiently imprecise, that the lower end locations of at least one of said shear pads deviates from a common plane defined by the lower end locations of three other ones of said shear pads, by at least 0.2 degrees as measured from a location on said common plane that lies at the center of said circle.

9. The arrangement described in claim 8 wherein:

said turret has a diameter of about 4 meters, and said location on said at least one shear pad deviates at least one-quarter inch from said plane.

10. Apparatus for supporting an upper bearing which holds an offshore turret upper portion, on a mount that is fixed to a hull of a vessel, comprising:

a quantity of elastomeric material which supports the weight of said upper bearing on said mount, and that permits pivoting of said upper bearing by elastic deformation of said elastomeric material;

a resiliently deflectable support structure that includes at least three posts each having an upper post portion coupled to said upper bearing to support it and a lower post portion coupled to said rigid mount to be supported thereon, said posts each forming a gap between said post portions, and including a shear pad lying in said gap and connecting said upper and lower post portions, with each of said shear pads including top and bottom mounting plates each connected to a corresponding post portion and part of said quantity of elastomeric material lying between said mounting plates, and with each of said post portions being narrow enough near said shear pads to leave the corresponding mounting plate of the shear pad substantially unobstructed to easy replacement of the shear pad by disconnecting said mounting plates from said post portions.

11. The apparatus described in claim 10 including:

a limiter member having a limiter end rigidly connected to one of said shear pad mounting plates and an opposite end that substantially surrounds the other mounting plate.

12. Apparatus for supporting a turret in relative rotation about a largely vertical turret axis on a vessel hull, which includes an upper mount assembly for supporting a radial and axial upper bearing that holds an upper turret portion on a mount that is fixed to the vessel hull, and a lower mount assembly that supports a turret lower portion on a radial bearing, comprising:

a quantity of elastomeric material which supports said upper bearing on said mount, and which permits slight pivoting of said upper bearing with respect to said mount from an initial position by elastic deformation of said elastomeric material;

a limiter which is coupled to said bearing and to said mount and which prevents their relative pivoting about said turret axis by more than a predetermined amount that is on the order of two degrees.

13. The apparatus described in claim 12 wherein:

said quantity of elastomeric material includes a plurality of shear pads that each have a plurality of sheets of said elastomeric material and a plurality of rigid plates between said sheets and which also has upper and lower mounting plates;

said limiter includes a limiter member that is fixed to a first of said mounting plates and that surrounds the second of said mounting plates but which does not engage said second mounting plate until there is sideward shear of said elastomeric plates.

14. Apparatus for aiding in the replacement of a turret upper bearing that supports a turret upper portion in rotation about a primarily vertical axis on a mount assembly that is supported on a vessel hull, comprising:

a turret bearing part fixed to said turret and a mount bearing part fixed with respect to said mount assembly, with said bearing parts engaging each other when said turret upper portion moves radially by an amount that is greater than an amount of radial confinement provided by said upper bearing, and when said turret moves down from a position at which it is supported by said upper bearing.

15. A mooring arrangement which includes a vessel with a hull that floats at the surface of a sea and that can drift and weathervane, a turret, and vertically spaced upper and lower mount assemblies holding vertically spaced upper and lower portions of the turret to the hull to enable relative rotation of the vessel and turret about a largely vertical axis, wherein the turret has a lower end anchored by at least one mooring line or the like extending down toward the sea floor which applies a largely downward force to the lower end of the turret, wherein said lower mount assembly includes a lower bearing that limits radial movement of said turret with respect to said hull, and said upper mount assembly includes an upper bearing that limits both radial and downward movement of said turret with respect to said hull, said upper mount assembly also including a substantially rigid mount fixed to said vessel hull and a support structure which supports said upper bearing on said upper mount, characterized by:

said support structure includes a plurality of hydraulic actuators spaced about said axis, each actuator having a cylinder part and a piston part, one part of each actuator coupled to said mount and the other part thereof coupled to a location on said upper bearing, with said upper bearing being supported on said mount through said hydraulic actuators.

16. The arrangement described in claim 15 wherein:

said support structure includes a plurality of posts with a shear pad that includes elastomeric material lying along each post, and with each actuator lying in series with one of said posts.

17. The arrangement described in claim 15 wherein:

the piston and cylinder parts of each of said actuators are fixed together so for each actuator the piston part cannot move relative to the cylinder part thereof, after operation of said actuators.

18. A method for installing a turret held by upper and lower bearings, on a vessel that has upper and lower mounts, where the turret has a substantially vertical axis, the upper bearing provides radial and axial support for the turret and is to be supported through a support structure on the upper mount, and the lower bearing provides only radial confinement of the turret, comprising:

establishing each of a plurality of substantially identical hydraulic actuators that each includes a cylinder and a piston, between an upper location on said upper bearing and a lower location on said upper mount, with said upper locations spaced about said axis and said lower locations spaced about said axis;

after said turret is supported on said upper and lower bearings with said lower bearing being supported on said vessel, pumping hydraulic fluid into all of said actuators at the same pressure, to slightly raise said upper bearing while allowing it to tilt slightly into alignment with said lower bearing.

* * * * *